US009097409B2

(12) United States Patent
Plomteux et al.

(10) Patent No.: US 9,097,409 B2
(45) Date of Patent: Aug. 4, 2015

(54) LENS RETENTION CLIP FOR LUMINAIRE

(75) Inventors: Alexandre Plomteux, Montréal (CA); Sergio Fabian Jurdana, Blainville (CA)

(73) Assignee: Koninklijke Philips N.V., Eindhoven (NL)

( * ) Notice: Subject to any disclaimer, the term of this patent is extended or adjusted under 35 U.S.C. 154(b) by 83 days.

(21) Appl. No.: 14/115,393

(22) PCT Filed: May 4, 2012

(86) PCT No.: PCT/IB2012/052249

§ 371 (c)(1), (2), (4) Date: Nov. 4, 2013

(87) PCT Pub. No.: WO2012/156859

PCT Pub. Date: Nov. 22, 2012

(65) Prior Publication Data

US 2014/0071699 A1 Mar. 13, 2014

Related U.S. Application Data

(60) Provisional application No. 61/485,802, filed on May 13, 2011.

(51) Int. Cl.

| | |
|---|---|
| ***F21V 15/01*** | (2006.01) |
| ***F21K 99/00*** | (2010.01) |
| ***F21V 17/00*** | (2006.01) |
| ***F21V 29/00*** | (2015.01) |
| ***F21V 31/00*** | (2006.01) |
| ***F21V 29/507*** | (2015.01) |

(52) U.S. Cl.

CPC ..... *F21V 15/011* (2013.01); *F21K 99/00* (2013.01); *F21V 17/00* (2013.01); *F21V 29/004* (2013.01); *F21V 29/507* (2015.01); *F21V 31/005* (2013.01)

(58) Field of Classification Search

CPC ..... F21K 9/00; F21K 9/30; F21V 15/011; F21V 17/002

USPC ..... 362/545, 546, 547, 549, 455, 396

See application file for complete search history.

(56) References Cited

U.S. PATENT DOCUMENTS

| | | | | |
|---|---|---|---|---|
| 3,315,072 | A * | 4/1967 | Harling | 362/329 |
| 4,460,945 | A * | 7/1984 | Chan et al. | 362/294 |
| 5,651,612 | A * | 7/1997 | Braun | 362/376 |
| 5,941,632 | A * | 8/1999 | Wedell et al. | 362/410 |
| 7,674,012 | B1 * | 3/2010 | Lin et al. | 362/249.02 |
| 8,007,143 | B2 * | 8/2011 | Liu | 362/373 |
| 2008/0068799 | A1 * | 3/2008 | Chan | 361/697 |

FOREIGN PATENT DOCUMENTS

| | | | |
|---|---|---|---|
| CN | 201434347 | Y | 3/2010 |
| DE | 202009000344 | U1 | 3/2009 |

* cited by examiner

*Primary Examiner* — Ali Alavi

(74) *Attorney, Agent, or Firm* — Meenakshy Chakravorty

(57) ABSTRACT

A luminaire heat sink housing (40) which has a lens locking clip (20) which retains the lens (30) against a gasket (50). Both the hinged locking clip (20) and the heat sink housing (40) may be extruded to any desired length and allows the lens be readily removed. The hinged locking clip (20) extends along a side of the housing (40) and lockingly slides into place to bias the lens (30) against a gasket (50) and seals the light engine within the interior of the heat sink housing. The locking clip is removable from the housing and includes a locking clip rotation head, lens retention surface and locking head to affix the lens in position against the gasket and in front of the LEDs (55).

1 Claim, 4 Drawing Sheets

LENS RETENTION CLIP FOR LUMINAIRE

TECHNICAL FIELD

The field of the present structure is luminaire housings and particularly to heat sink housings which utilize a removable locking clip against a lens to seal the interior components of the heat sink.

BACKGROUND OF THE INVENTION

Outdoor luminaires require both continuous and effective seals for the internal electronics as well as easy access for maintenance purposes, two goals which are often at odds with each other. This is particularly of import when considering the environmental conditions which outdoor lighting operates. Most systems have attempted to accomplish such with permanent seals positioned around the lens so that these seals are never breached during the life of the luminaire. Other luminaire housings have included various hinged lens frame structures which require removable screws be utilized. However, use of such technology often requires tapping holes into the housing which extend around the perimeter of the lens and the areas to be sealed. Such structure requires additional assembly and manufacturing steps as well as causes potential breach areas for moisture and other dirt to intrude into the interior of the housing. Such moisture, dust, dirt and foreign substance intrusion reduces the life expectancy of the luminaire, changes the overall light output and footprint of the lamps and possibly can foul the electronics. Further, maintenance using removable screws around the perimeter of the lens can increase the difficulty in maintenance by requiring personnel to remove the threads with tools and typically in a high position in a bucket.

Further, such affixation structures can also pinch or provide improper pressure on the seals positioned between the lens frame and the housing. Such structure requires direct alignment of the lower and upper frame portions so that the tap holes allow for the screws to be threaded readily therethrough. After significant use or after repeated heating and cooling cycles, misalignment can result thereby making maintenance and reassembly that much more difficult.

With new LED technology, the requirement for large voluminous interior cavities for outdoor light fixture heat dissipation is additionally reduced. Therefore, direct threading by bolts or screws of a lower lens frame over an LED panel or light engine requires unneeded housing structure which also interferes with the cooling characteristics of the LEDs or of the head sink. Such direct affixation can further cause transference of the heat energy from the main housing or heat sink directly to the lens.

SUMMARY

The luminaire housing described herein sets forth a heat sink housing for mounting of a lens structure which sealingly engages a gasket retained in the heat sink. A hinge clip is rotatingly and slideably retained within a hinge channel to move upwards against the lens and provide biasing pressure against the lens thereby sealing the interior area of the housing by virtue of the peripherally extending gasket. The hinge clip locks into place thereby retaining the lens over the LEDs while maintaining an adequate seal to prevent moisture and other environmental intrusion which may cause damage to the LED and PCB electronics.

In some embodiments the present structure sets forth a luminaire with an LED illumination engine mounted on a heat sink and mounted within a luminaire housing, the lens system for the outdoor luminaire not requiring a lens frame and being directly and removably affixed to the heat sink for easy removal and maintenance.

Other embodiments of the outdoor luminaire having an LED light engine may include a removable lens assembly which may be directly affixed to the gasket or other seal device and placed directly in front of the LEDs.

In various structures described, the LED PCB may be mounted to a heat sink for dissipation of the heat generated by the LEDs while the lens is directly mounted on the heat sink and in front of the LEDs and against the gasket material thereby properly sealing the LEDs and other electronics from exterior environmental conditions.

As shown in the various figures and in some embodiments, the lens may be hingedly and removably affixed to the heat sink by a longitudinally extending clip which rotates relative to the heat sink housing and compresses the lens against the gasket structure. The clip may be positioned and structured in many ways but is meant to allow such rotation to compress the lens against the gasket while also locking the lens into proper sealed position.

In other embodiments, the entire LED, PCB, Heat Sink and lens assembly may be assembled and then placed into the interior of an additional housing.

Presently, as described in various constructions, the heat sink and clip configuration includes a clip which extends along a side of the lens and hingedly affixes to the unitary heat sink along a hinge clip channel. The hinge clip compresses the lens in position in front of the LEDs and locks the lens in position while also maintaining sufficient pressure on the lens and gasket to seal the internal LED PCB and other electronics.

In various embodiments, the housing for the heat sink is unitary and allow for mounting of the LED PCB along a back surface thereof. The mounting surface is in thermal communication with an external surface for heat dissipation purposes.

The hinge clip may include, in the included and multiple depictions, a clip rotation head, a hinge clip neck portion, a hinge clip lens retention surface and a hinge clip locking head, all of which interact with the lens and the heat sink housing to lock the lens in proper position and seal in the LED and PCB structures positioned within the housing.

In various embodiments depicted the hinge clip is retained in the housing within a hinge channel. In other variations, the hinge clip may be retained on additional structure of the housing which allows the hinge clip to be rotatingly affixed thereto.

In some variations, the hinge clip is both rotationally retained within the hinge clip channel while also laterally moveable within the channel. In other variations, the hinge clip may be rotationally and lockingly engaged to the heat sink housing.

The lens may be positioned in various embodiments to directly engage the lens gasket along its entire periphery thereby ensuring proper protection of the interior electronics area of the heat sink housing where the PCB is mounted.

The heat sink housing may be extrusion molded as a unitary or multi-piece structure.

In variations described herein, the hinge clip may further be extrusion molded for interaction with the heat sink housing.

In other embodiments, the lens retention hinge clip may rotate within a hinge channel extending along a side periphery of the housing. The clip may then rotated to compress against the lens and then slide into locking engagement with a locking head of the housing.

In other variations, the lens retention hinge clip may be snap fitted onto a rotational receiving surface allowing the clip to freely rotate but snap into proper position to maintain bias of the lens against the gasket.

In various constructions, the hinged locking clip may have a C-shaped rotation head which can slidingly fit through a hinge channel aperture of the heat sink housing. The rotation head may be slightly compressible in order that the diameter of the rotation head may be reduced when inserting the rotation head through the aperture.

In still other variations, the present description sets forth a heat sink and associated clip and lens wherein the lens is fastened by means of a clip made by an extrusion process that slides and is partially free to move within the luminaire heat sink or similar housing extrusion.

The described construction, in one embodiment, sets forth two interlocking extrusion assemblies, a heat sink section where the LEDs or other light engine structure are located, and wherein the luminaire lens is fastened to the housing means of a clip made by an extrusion process that slides and is partially free to move in the heat sink extrusion. Such construction reduces the number of parts required to assemble the lens into the luminaire housing and also reduce the assembly and other labor requirements.

Additional benefits of the various designs set forth include the ability to create dual extrusions, in one embodiment, which may be made of any length desirable which can be cut to length according to luminaire or light engine requirements.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs. It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION OF THE VARIOUS EMBODIMENTS

Outdoor lighting fixtures frequently require access for maintenance purposes. These luminaire's must therefore be constructed to include structure for repeated entry while also maintaining proper sealing engagement of the access panels or doors. Incorporating into such luminaire a tool-less construction is also desirable in that utilizing tools to enter a luminaire housing after installation may be difficult due to position, mounting height and other restrictions. Also, repeated access by using screws and other mechanical devices may further weaken the seal or other structure which prevents moisture from entering the housing interior. This is particularly true when heat sink structures are combined with LED light engines. While inclusion of LEDs allows for much narrower or smaller footprint and overall housing dimensions, consideration must be given to the proper sealing and engagement techniques used with the LED PCB electronics or the LED heat sink features, all of which must be readily accessible after installation.

Thus, there is a need to provide a heat sink housing for an outdoor luminaire which implements an easy entry enclosure structure which provides adequate sealing to the housing while also allowing for ready access to the interior electronics.

More importantly, Applicants have recognized the need and benefit of a LED heat sink housing which works in conjunction with a hinged retention clip working with the lens to compress the lens in biasing relation against a peripherally extending gasket seal while maintaining biasing pressure against the gasket to prevent moisture and dirt intrusion into the electronic housing area.

In view of the forgoing, various embodiments and implementations of the heat sink housing for an LED light engine and hinge clip for the lens are described herein.

A biasing and locking clip is provided in conjunction with a luminaire heat sink housing which interlocks with a housing clip structure to lock the clip in place against a lens, the lens being locked into position against a gasket thereby sealing the interior components of the heat sink housing. The hinged clip is structured to rotate within a receiving channel of the housing and lock into place in an interference locking relationship with structure formed on the heat sink clip receiving channel, the clip receiving or hinge channel allowing the clip to both rotate and move in a translational motion to place the clip and housing in the aforementioned locking relationship.

Of benefit with the design is the heat sink housing may be constructed of extruded metal or other material, such as aluminum, to any desired length while the clip may similarly be extruded to work in conjunction with the housing for locking the lens in place thereby sealing the LEDs or other light engine components within the interior of the housing. The housing may then be positioned within the interior of other luminaire components if needed.

Figure 1:
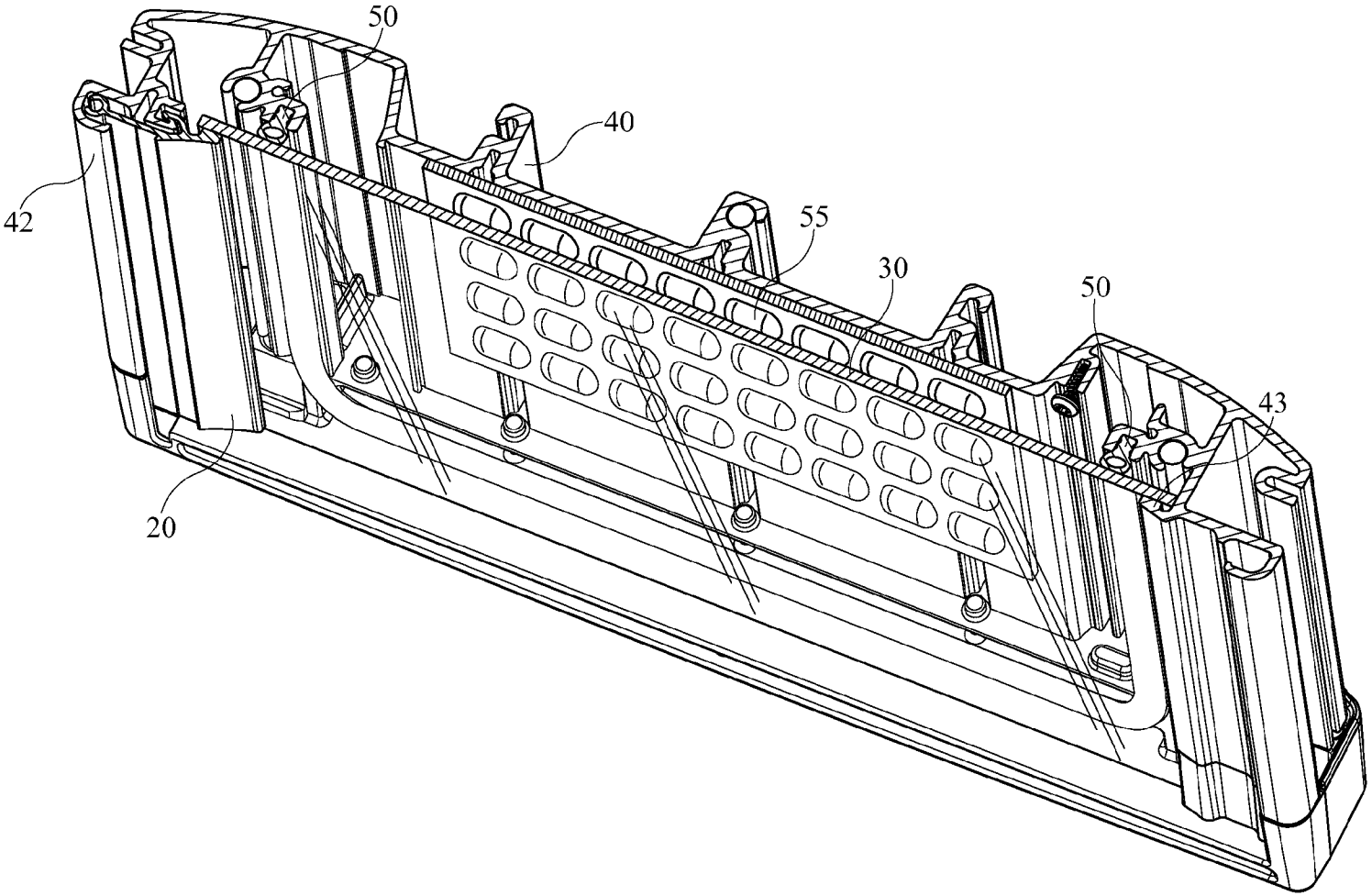
FIG. 1 illustrates a perspective cut away view of a heat sink with lens and retention clip structure.

Turning to FIG. 1, a sectional perspective view of one end of the heat sink housing 40 is shown. The heat sink housing may be an extruded unitary material design to allow heat to transfer from the LED light engine and PCB 55, mounted on the front lower surface, to the rear heat dissipation surface 41. The LEDs shown are retained in an interior area of the housing which is surrounded by a peripherally extending gasket 50, the gasket maintained in a gasket channel 46 of the heat sink 40.

Figure 2:
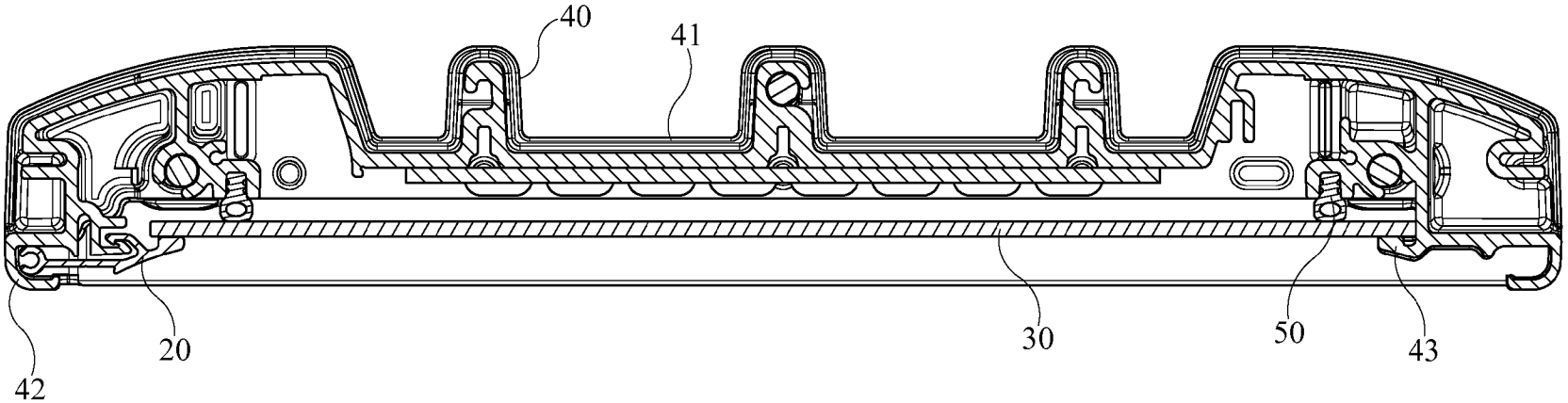
FIG. 2 illustrates a side view of the hinge clip and heat sink housing of FIG. 1 shown in the closed and locked position.
Figure 3:
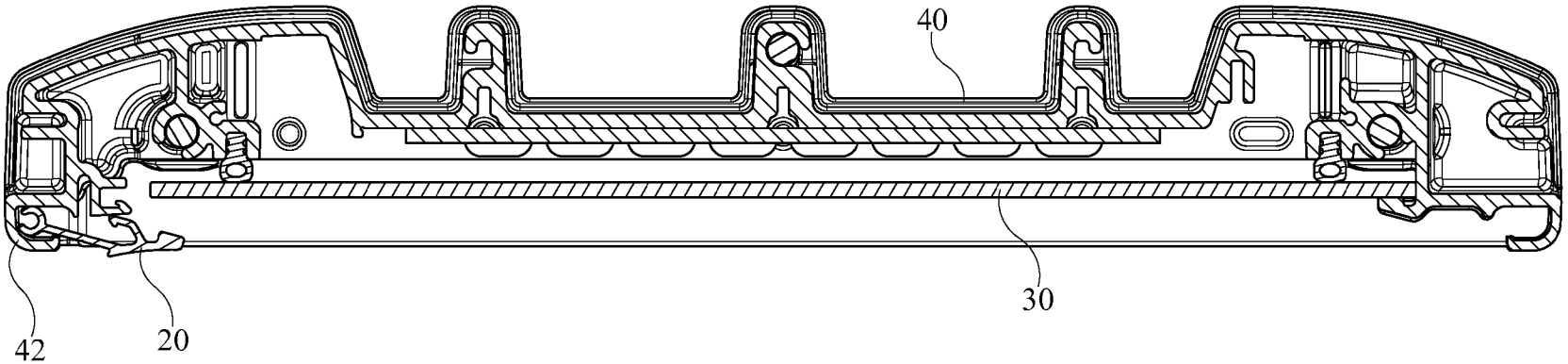
FIG. 3-5 illustrates a side view of the hinge clip and heat sink housing of FIG. 1 shown in various installation positions.
Figure 4:
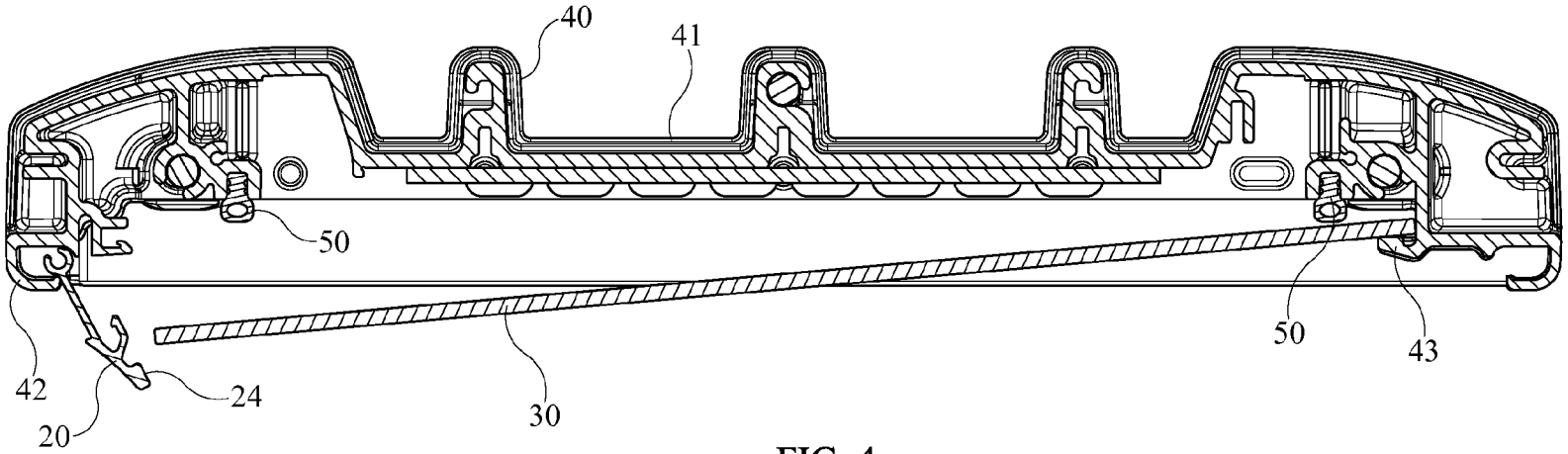
Figure 5:
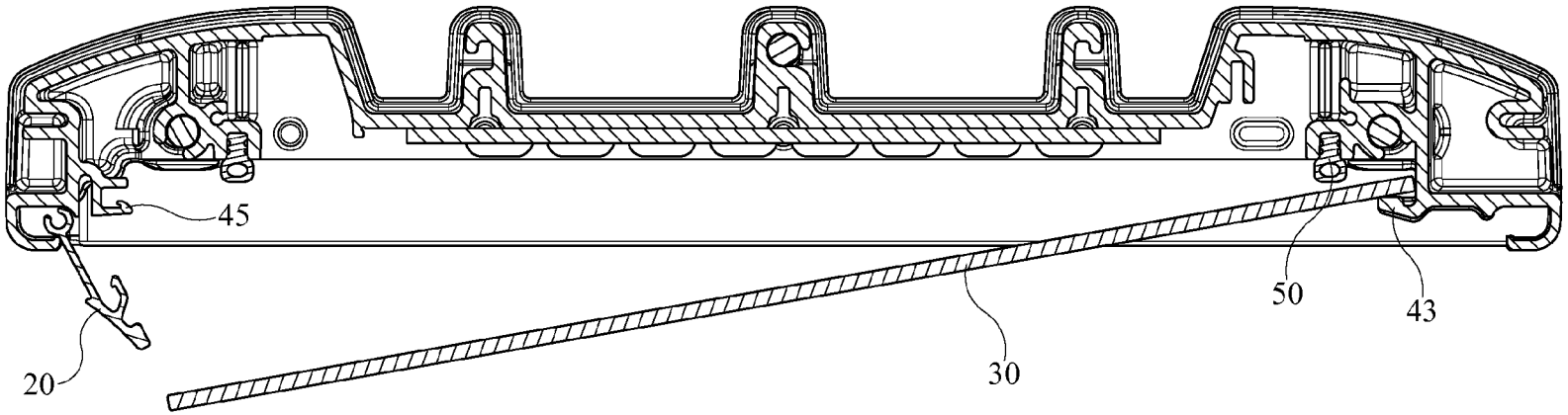
Figure 6:
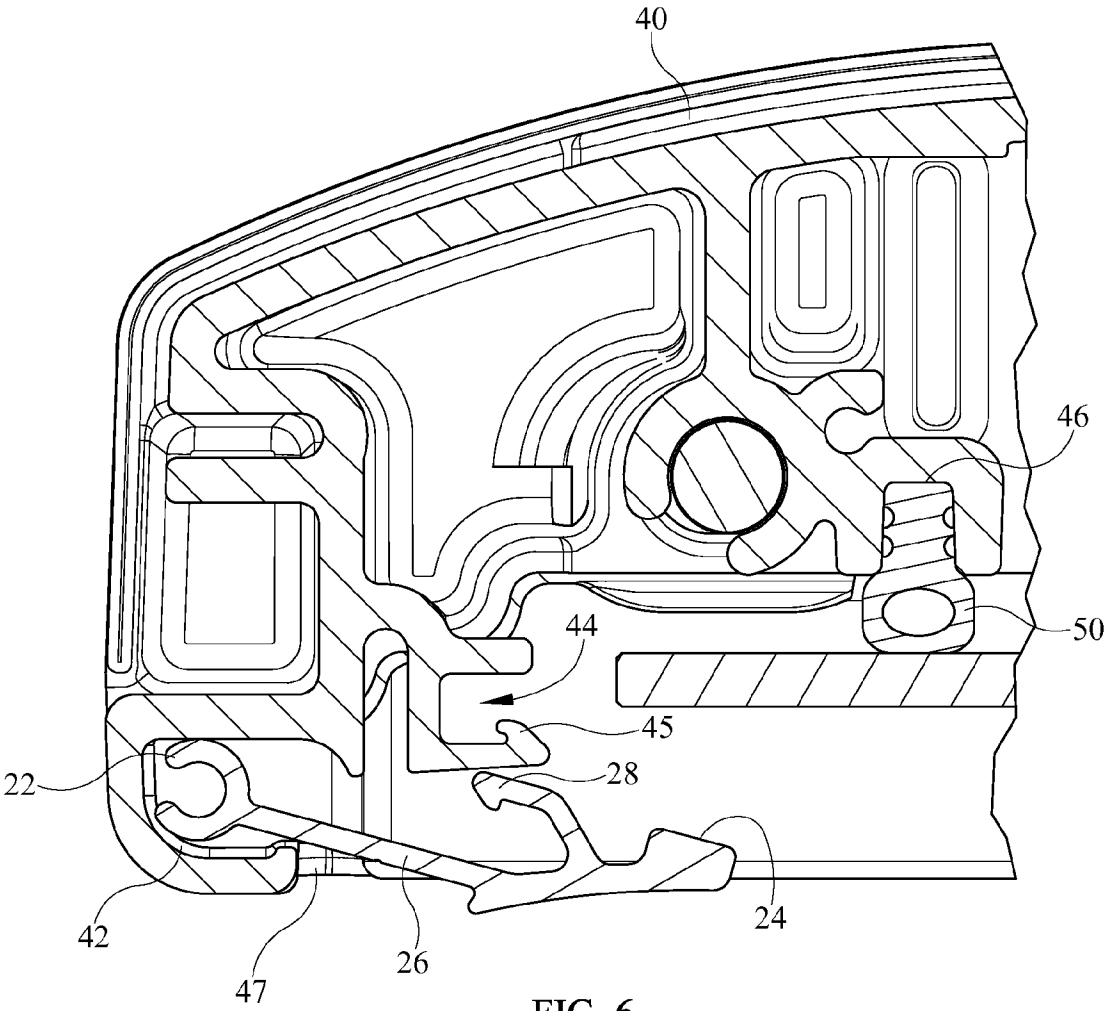
FIG. 6 illustrates a close-up side sectional view of the hinge clip and heat sink housing of FIG. 1.

As depicted in this embodiment, a hinge clip 20 is provided and rotatingly positioned relative to a hinge point on the heat sink housing 20 to allow the lens to be positioned into place against the gasket 30 and directly below and adjacent the LEDs 55. The hinge clip 20, in this embodiment, rotates relative to the housing hinge channel 42 (see FIG. 6) by hinge clip rotation heat 22. The hinge clip 20 depicted in the embodiment rests in the hinge channel 42 to rotate freely therein and also to move laterally from right to left in the figure such that the clip may be locked in position as shown in FIG. 2. However, sufficient clearance is provided to allow the hinge clip 20 to move out of the way of the lens 30 but thereafter positioning the lens against the gasket and allowing the locking head 28 to engage the locking clip 45 and maintain proper biasing of lens retention surface 24 against lens 30.

The heat sink 40 is shown in the depicted embodiment as being unitary although many constructions may be implemented. However, unitary construction as depicted allows the heat sink to be made of a metal such as aluminum, which transfers energy away from the PCB and LEDs 55 thereby allowing proper heat dissipation. The LEDs 55 may be mounted to the lower facing surface of the heat sink 40 in many different manners including adhesion or mechanical devices such as clamps, screws and the like.

In some embodiments, the heat sink 40 may also be multiple pieces which fit together to form a heat transfer block. In other embodiments, the heat sink may be extruded aluminum or similar metal or to aid in the manufacturing and assembly of the various elements.

As shown in FIG. 1, the heat sink is a unitary structure which allows the LEDs to be mounted into an interior space thereof allowing the LEDs to emit light downward through the lens 30. The housing 40 may include, in various embodiments, a gasket receiving channel 46 which receives a peripherally extending gasket 50 around the interior area which receives the electronics. The gasket receiving area may be a channel, locking mechanism, retention device or other structure which effectively maintains the gasket in position around the LEDs while maintaining the ability of the gasket to prevent moisture and other element intrusion into the interior space retaining the PCBs, LEDs or light engine electronics.

In the present embodiment, the gasket receiving channel extends around the entire periphery of the LEDs. Alternatively, the gasket may be retained by posts, adhesion or other devices which accomplishes the same affect.

The heat sink housing 40 defines the interior space for the LEDs for proper positioning. LED driver electronics, power supply and other electronics may be similarly included within an interior of the heat sink housing or alternatively may be positioned external to the heat sink housing. If external, proper access to the interior for wires, connections and other electronic communications must be accounted for while also maintaining adequate moisture intrusion, including wicking prevention.

The heat sink housing as shown may be only a portion of an entire luminaire assembly which mounts internally within a luminaire housing (not shown). Alternatively, the heat sink housing 40 may act as a luminaire housing on its own.

Heat sink housing further includes, in some embodiments, a hinge channel 42 for receiving the hinge clip 20. As shown in this embodiment, the hinge clip 20 has a hinge clip rotation head 22 which slides into the hinge channel 42. Positioning of the clip rotation head 22 into the channel 42 may be accomplished through the longitudinally extending channel aperture 47, thereby allowing the C-shaped clip rotation head 22 to slightly compress during insertion.

The hinge clip rotation head 22 may be, in certain embodiments, C-shaped providing an untensioned diameter which is slightly larger than a channel aperture formed along the length of the hinge channel of the heat sink housing. The rotation head 22 may be slightly compressed to fit within the hinge channel and once rotationally embedded therein the hinge clip rotation head remains rotationally and slidingly in place. Of course, many alternative constructions for the rotation head of the hinge clip may be implemented so as to provide rotation of the clip within a defined channel. Such alternative and functionally equivalent structures are considered to fall within the scope and teachings hereof.

In alternative constructions, the housing 40 may include an open end which allows the hinge clip rotation head to slide internally to the hinge channel from and open end.

The hinge clip 20 may include the C-shaped rotation head, a neck portion 26, a lens retention surface 24 and a locking head 28. As shown in the various constructions of FIGS. 1-6, the clip 20 may rotate to allow the lens to be positioned against the lens retention lip 43 of the heat sink housing and then rotated into position against the gasket 50, as shown in FIGS. 2-5. After final installation, the lens is compressively positioned against the gasket 50 which may have an open central region for compressively sealing interior and exterior portions of the heat sink housing 40.

The clip 20 may be rotationally retained within the hinge channel 42 or alternatively may be retained on a rotational knob or other structure allowing the clip to be positioned out of the way of the lens while the lens is positioned adjacent the LEDs and compressively against the gasket 50. As shown and depicted, the hinge clip 20 once locked into a final closed construction as shown in FIG. 2, may maintain a biasing position of the lens against the gasket as well. The hinge channel 42 shown in this embodiment allows for both rotational movement of the clip 20 and also translational movement from left to right, as shown, to allow the locking head 28 to properly engage the locking clip 45 of the housing 40. Locking receptacle 44 receives the locking head 28 and allows the locking head 28 to be maintained in the closed and locked position of FIG. 2.

To open the clip 20 and remove the lens 30, upward and outward force is provided on the clip 20 to release the locking head 28 from engagement with locking clip surface 45 of the housing 40.

In the construction depicted, the locking clip 40 provides biasing force against the lens 30 along an entire side surface thereby ensuring proper engagement with the gasket 50 and sealing engagement and enclosure of the light engine or other internal LEDs.

Various constructions may also be included to allow for similar rotation and locking of the clip 20 to provide pressure along an entire side of the lens 30. For example, the locking clip may rotate along an outwardly extending ovalized structure allowing rotation of the locking while the clip itself may have a pliable locking head which may flex around a similarly constructed structure on the heat sink. Such alternative constructions are to be considered included within the teachings hereof as one of ordinary skill, after reading the description hereof, would understand such similar and other structures performing the similar function to be within the scope of the various embodiments disclosed.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What we claim is:

1. A luminaire heat sink housing and locking clip, comprising:

a heat sink housing receiving a plurality of LEDs on a LED mounting surface, said LEDs thermally mounted on said LED mounting surface, said LED mounting surface forming an interior wall of said heat sink housing;

a gasket receiving channel circumscribing said LED mounting surface;

a compressible gasket positioned within said gasket receiving channel;

a longitudinally extending lens retention lip spaced away from said LED mounting surface and on a first side of said heat sink housing;

a longitudinally extending hinge clip channel positioned opposite said first side of said heat sink housing;

a hinge clip rotationally retained within said hinge clip channel, said hinge clip having a rotation head within said hinge clip channel, a neck portion extending outward from said channel and through a channel aperture, and a lens retention surface abutting against a lens and a locking head;

wherein said heat sink housing has a locking receptacle for receiving said locking head of said hinge clip;

said hinge clip laterally slidable within said hinge clip channel.

* * * * *